US009719532B2

(12) United States Patent
Kojima et al.

(10) Patent No.: US 9,719,532 B2
(45) Date of Patent: Aug. 1, 2017

(54) FLUID PRESSURE CONTROL DEVICE FOR POWER SHOVEL

(71) Applicant: KAYABA INDUSTRY CO., LTD., Tokyo (JP)

(72) Inventors: Masanari Kojima, Kanagawa (JP); Masayuki Nakamura, Kanagawa (JP); Takeshi Terao, Kanagawa (JP)

(73) Assignee: KYB Corporation, Tokyo (JP)

( * ) Notice: Subject to any disclaimer, the term of this patent is extended or adjusted under 35 U.S.C. 154(b) by 370 days.

(21) Appl. No.: 14/433,614

(22) PCT Filed: Nov. 5, 2013

(86) PCT No.: PCT/JP2013/079852
§ 371 (c)(1),
(2) Date: Apr. 3, 2015

(87) PCT Pub. No.: WO2014/073515
PCT Pub. Date: May 15, 2014

(65) Prior Publication Data

US 2015/0330416 A1 Nov. 19, 2015

(30) Foreign Application Priority Data

Nov. 7, 2012 (JP) ..... 2012-245782

(51) Int. Cl.
*F15B 13/02* (2006.01)
*E02F 9/22* (2006.01)
*F15B 11/17* (2006.01)

(52) U.S. Cl.
CPC ..... *F15B 13/022* (2013.01); *E02F 9/2239* (2013.01); *E02F 9/2285* (2013.01);
(Continued)

(58) Field of Classification Search
CPC ..... E02F 9/2239; E02F 9/2285; E02F 9/2292; F15B 11/17; F15B 13/022;
(Continued)

(56) References Cited

U.S. PATENT DOCUMENTS 9,057,175 B2 * 6/2015 Saotome ..... E02F 9/2239

FOREIGN PATENT DOCUMENTS

CN 1699761 A 11/2005
EP 1598561 A2 11/2005
(Continued)

*Primary Examiner* — Logan Kraft
(74) *Attorney, Agent, or Firm* — Rabin & Berdo, P.C.

(57) ABSTRACT

A fluid pressure control device for a power shovel includes: a first switching valve configured to permit or prohibit communication between a first pump and a first cylinder; a second switching valve configured to permit or prohibit communication between a second pump and a second cylinder; a third pump configured to allow to supply working fluid to the first cylinder and the second cylinder; a first junction control valve configured to permit or prohibit communication between the third pump and the first cylinder or the second cylinder; and a communication control valve configured to prohibit communication between the third pump and the first cylinder to guide the working fluid discharged by the third pump to the second cylinder by controlling the first junction control valve in a case where the second pump is communicated with the second cylinder by the second switching valve regardless of whether or not the first pump is communicated with the first cylinder by the first switching valve.

6 Claims, 1 Drawing Sheet

(52) U.S. Cl.
CPC ..... *E02F 9/2292* (2013.01); *F15B 11/17* (2013.01); *F15B 2211/20576* (2013.01); *F15B 2211/255* (2013.01); *F15B 2211/265* (2013.01); *F15B 2211/30595* (2013.01); *F15B 2211/4053* (2013.01); *F15B 2211/45* (2013.01); *F15B 2211/71* (2013.01); *F15B 2211/7142* (2013.01); *F15B 2211/781* (2013.01)

(58) Field of Classification Search
CPC ..... F15B 2211/20576; F15B 2211/255; F15B 2211/265; F15B 2211/30595; F15B 2211/4053; F15B 2211/45; F15B 2211/71; F15B 2211/7142; F15B 2211/781
See application file for complete search history.

(56) References Cited

FOREIGN PATENT DOCUMENTS

| | | | |
|---|---|---|---|
| JP | 54-164391 | U | 11/1979 |
| JP | 1998-088627 | A | 4/1998 |
| JP | 2005-121043 | A | 5/2005 |
| JP | 2005-331011 | A | 12/2005 |
| JP | 2006-328765 | A | 12/2006 |
| JP | 2012-036909 | A | 2/2012 |
| WO | WO 2012-017622 | A1 | 2/2012 |

* cited by examiner

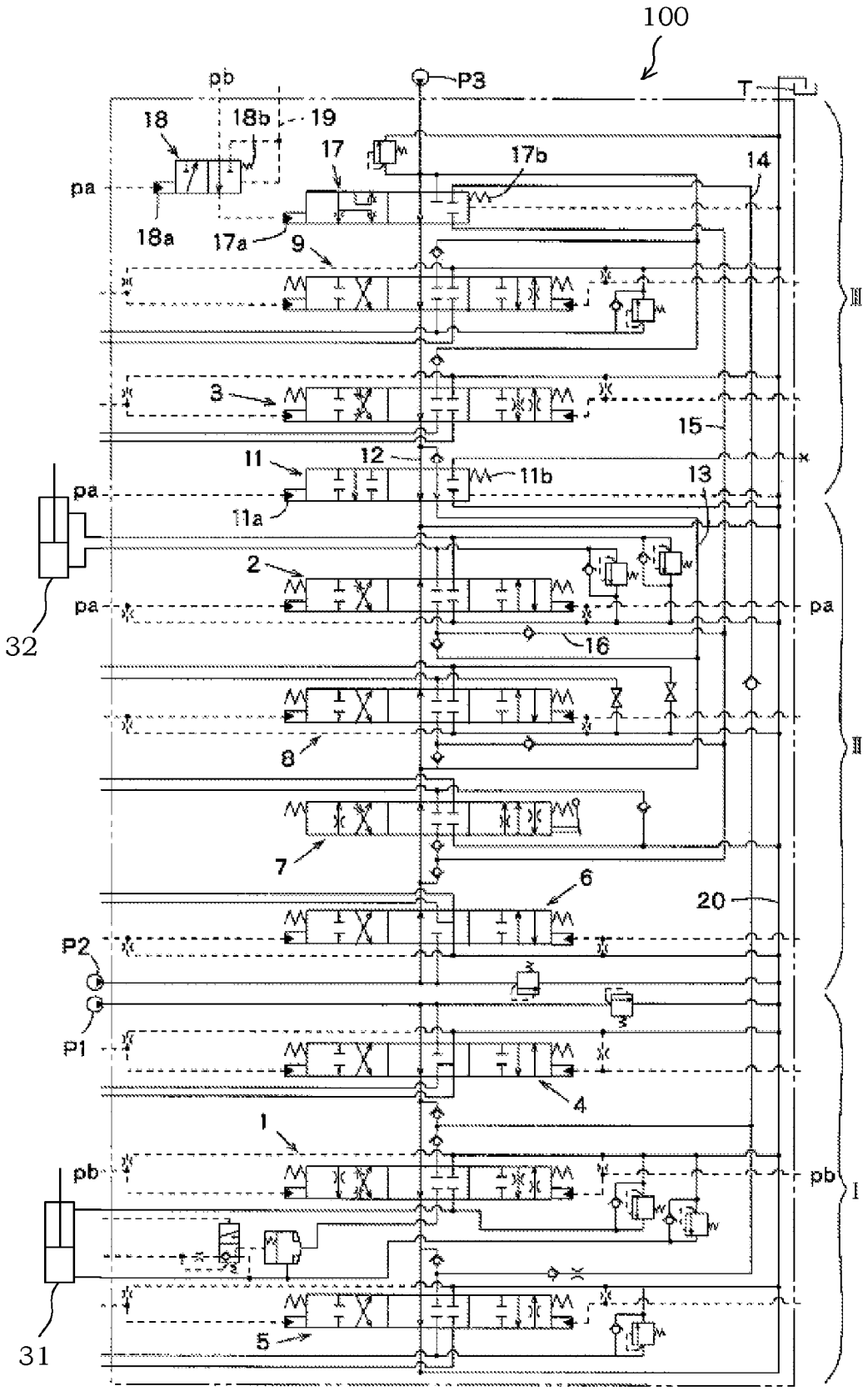
100
pb
P3
T
18
18b
19
17
17b
14
pa
18a
17a
9
III
3
15
11
12
11b
13
pa
11a
2
pa
pa
32
16
8
II
7
6
20
P2
P1
4
1
pb
pb
I
31
5

FLUID PRESSURE CONTROL DEVICE FOR POWER SHOVEL

TECHNICAL FIELD

The present invention relates to a fluid pressure control device for a power shovel.

BACKGROUND ART

As a hydraulic control device for a power shovel, one in which first to third circuit systems are respectively connected to first to third pumps and oil discharged by the third pump is caused to join the first and second circuit systems as necessary is known.

A control circuit disclosed in JP1998-88627A is configured so that oil discharged by a third pump is supplied to a boom cylinder when only a boom switching valve provided in a first circuit system is switched, the oil discharged by the third pump is supplied to an arm cylinder when only an arm switching valve is switched, and the oil discharged by the third pump is preferentially supplied to the arm cylinder when the boom switching valve and the arm switching valve are simultaneously switched.

Specifically, the control circuit described above includes a hydraulic accelerating valve for preferentially supplying oil discharged by the third pump to the arm cylinder. The hydraulic accelerating valve includes two pilot chambers to which a pilot pressure of the boom switching valve and a pilot pressure of the arm switching valve are respectively guided, and a spring that applies a biasing force in the same direction as that of the pilot pressure of the arm switching valve.

The hydraulic accelerating valve switches so as to supply the oil discharged by the third pump to the boom cylinder in a case where the pilot pressure of the boom switching valve overcomes the biasing force of the spring when only the pilot pressure of the boom switching valve is applied. The hydraulic accelerating valve switches so as to supply the oil discharged by the third pump to the arm cylinder by means of the pilot pressure of the arm switching valve and the biasing force of the spring when only the pilot pressure of the arm switching valve is applied. Further, the hydraulic accelerating valve switches so as to supply the oil discharged by the third pump to the arm cylinder in a case where a resultant force of the pilot pressure of the arm switching valve and the biasing force of the spring overcomes the pilot pressure of the boom switching valve when the pilot pressures of both the boom switching valve and the arm switching valve are applied.

SUMMARY OF INVENTION

In the control circuit disclosed in JP1998-88627A, it is required that the biasing force of the spring of the hydraulic accelerating valve is set to a value that is smaller than the pilot pressure of the boom switching valve but overcomes a differential pressure of the two pilot pressures. For this reason, there has been a problem that selection of the spring is difficult.

It is an object of the present invention to provide a fluid pressure control device for a power shovel in which complicated selection of a spring is not required.

According to an aspect of the present invention, there is provided a fluid pressure control device for a power shovel, including: a first pump configured to supply working fluid to a first cylinder; a second pump configured to supply working fluid to a second cylinder; a first switching valve configured to permit or prohibit communication between the first pump and the first cylinder; a second switching valve configured to permit or prohibit communication between the second pump and the second cylinder; a third pump configured to allow to supply working fluid to the first cylinder and the second cylinder; a first junction control valve configured to permit or prohibit communication between the third pump and the first cylinder or the second cylinder; and a communication control valve configured to prohibit communication between the third pump and the first cylinder to guide the working fluid discharged by the third pump to the second cylinder by controlling the first junction control valve in a case where the second pump is communicated with the second cylinder by the second switching valve regardless of whether or not the first pump is communicated with the first cylinder by the first switching valve.

BRIEF DESCRIPTION OF DRAWINGS

FIG. 1 is a circuit diagram of a fluid pressure control device for a power shovel according to an embodiment of the present invention.

DESCRIPTION OF EMBODIMENT

A fluid pressure control device for a power shovel (hereinafter referred to simply as a "fluid pressure control device") 100 according to an embodiment of the present invention will be described with reference to FIG. 1.

The fluid pressure control device 100 is a device that utilizes hydraulic oil as a working fluid, and controls an operation of each of actuators that are installed in a power shovel.

The fluid pressure control device 100 includes: a first pump P1 that supplies working oil to a boom cylinder 31; a second pump P2 that supplies working oil to an arm cylinder 32; a third pump P3 that supplies working oil to a slewing motor; a boom switching valve 1 that is provided between the first pump P1 and the boom cylinder 31 and permits or prohibits communication between the first pump P1 and the boom cylinder 31; an arm switching valve 2 that is provided between the second pump P2 and the arm cylinder 32 and permits or prohibits communication between the second pump P2 and the arm cylinder 32; and a slewing switching valve 3 that is provided between the third pump P3 and the slewing motor and permits or prohibits communication between the third pump P3 and the slewing motor.

The fluid pressure control device 100 further includes: a first circuit system I that is connected to the first pump P1 and provided with the switching valve 1; a second circuit system II that is connected to the second pump P2 and provided with the switching valve 2; and a third circuit system III that is connected to the third pump P3 and provided with the switching valve 3.

A left-side travel switching valve 4 and a bucket switching valve 5 to which oil discharged by the first pump P1 is supplied are provided in the first circuit system I in addition to the boom switching valve 1. The oil discharged by the first pump P1 is supplied to the switching valves 1 and 5 only when the travel switching valve 4 is in a normal position (the state shown in FIG. 1). In this manner, in the first circuit system I, the oil discharged by the first pump P1 is preferentially supplied to the travel switching valve 4.

A right-side travel switching valve 6, a boom swing switching valve 7, and a backup actuator switching valve 8 to which oil discharged by the second pump P2 is supplied are provided in the second circuit system II in addition to the arm switching valve 2. In the second circuit system II, the oil discharged by the second pump P2 is also preferentially supplied to the travel switching valve 6.

In the present embodiment, the boom cylinder 31 corresponds to a first cylinder, and the boom switching valve 1 corresponds to a first switching valve. Further, the arm cylinder 32 corresponds to a second cylinder and the arm switching valve 2 corresponds to a second switching valve.

A dozer switching valve 9, a boom junction control valve 17, and an arm junction control valve 11 to which oil discharged by the third pump P3 is supplied are provided in the third circuit system III in addition to the slewing switching valve 3.

In the present embodiment, the boom junction control valve 17 corresponds to a first junction control valve, and the arm junction control valve 11 corresponds to a second junction control valve.

A center bypass passage 12 is connected to the third pump P3. The center bypass passage 12 guides the oil discharged by the third pump P3 to a tank passage 20 connected to a tank T when each of all the valves 17, 9, 3, and 11 provided in the third circuit system III is in a normal position.

The boom junction control valve 17 is provided downstream from the third pump P3 and at the most upstream point of the center bypass passage 12 in the third circuit system III.

The arm junction control valve 11 is provided at the most downstream point of the center bypass passage 12 and between the boom junction control valve 17 and the arm switching valve 2. The arm junction control valve 11 is a valve for guiding discharged oil, which is supplied to the center bypass passage 12 from the third pump P3, to the arm switching valve 2 when each of the other switching valves 3 and 9 and the boom junction control valve 17 provided in the third circuit system III is in a normal position. The arm junction control valve 11 includes a pilot chamber 11*a* that is connected to an arm system pilot pressure introducing passage pa that guides a pilot pressure for switching the arm switching valve 2. When the pilot pressure is not guided to the pilot chamber 11*a*, the arm junction control valve 11 is maintained in the normal position (the state shown in FIG. 1) by means of a biasing force of a spring 11*b* that serves as a biasing member.

An arm joining passage 13, which branches off from the center bypass passage 12 and is parallel to the center bypass passage 12, is connected to the arm junction control valve 11. The downstream side of the arm joining passage 13 is connected to the arm switching valve 2.

When the arm junction control valve 11 is in the normal position (the state shown in FIG. 1), the discharged oil supplied to the center bypass passage 12 is guided to the tank passage 20. For this reason, the oil discharged by the third pump P3 is not supplied to the arm cylinder 32 connected to the arm switching valve 2.

On the other hand, in a case where a pilot pressure is guided to the pilot chamber 11*a* so that the arm junction control valve 11 switches to a switched position, communication between the center bypass passage 12 and the tank passage 20 is cut off. For this reason, the oil discharged by the third pump P3 is guided to the arm joining passage 13.

In the present embodiment, the arm joining passage 13 is always communicated with the third pump P3 through the arm junction control valve 11. In place of this configuration, the arm joining passage 13 may be configured to communicate with the third pump P3 without the arm junction control valve 11.

When the arm switching valve 2 is switched, the arm junction control valve 11 switches. At this time, in a case where the other switching valves 3 and 9 and the boom junction control valve 17 in the third circuit system III have not been switched, the oil discharged by the third pump P3 joins the oil discharged by the second pump P2 through the center bypass passage 12 and the arm joining passage 13, and is supplied to the arm switching valve 2.

In the arm junction control valve 11, the normal position corresponds to a communication position in which the third pump P3 is communicated with the tank T, and the switched position corresponds to a closing position in which communication between the third pump P3 and the tank T is cut off.

The boom junction control valve 17 includes a pilot chamber 17*a* that is connected to a boom system pilot pressure introducing passage pb that guides a pilot pressure for switching the boom switching valve 1. When a pilot pressure is not guided to the pilot chamber 17*a*, the boom junction control valve 17 is maintained in the normal position (the state shown in FIG. 1) by means of a biasing force of a spring 17*b* that serves as a biasing member.

In the normal position (the state shown in FIG. 1) of the boom junction control valve 17, the third pump P3 is communicated with the center bypass passage 12, and communication between the third pump P3 and the boom cylinder 31 is cut off.

On the other hand, in a case where a pilot pressure is guided to the pilot chamber 17*a* so that the boom junction control valve 17 switches to a switched position, the third pump P3 is communicated with a boom joining passage 14 and a parallel passage 15. In the switched position, the third pump P3 is also communicated with the center bypass passage 12 via a throttle. However, the throttle mostly prohibits communication between the third pump P3 and the center bypass passage 12.

Therefore, when the boom switching valve 1 is switched, the boom junction control valve 17 also switches, and this makes it possible to guide the oil discharged by the third pump P3 to the boom switching valve 1.

In the boom junction control valve 17, the normal position corresponds to a closing position in which the communication between the third pump P3 and the boom cylinder 31 is cut off, and the switched position corresponds to a communication position in which the third pump P3 is communicated with the boom cylinder 31.

The boom junction control valve 17 may be configured so that the communication between the third pump P3 and the center bypass passage 12 is completely cut off in the switched position.

A communication control valve 18 is connected to the pilot chamber 17*a* of the boom junction control valve 17. The communication control valve 18 includes a pilot chamber 18*a* connected to the arm system pilot pressure introducing passage pa. The communication control valve 18 is maintained in a normal position (the state shown in FIG. 1) by means of a biasing force of a spring 18*b* that serves as a biasing member when a pilot pressure is not applied to the pilot chamber 18*a*. The communication control valve 18 switches to a switched position when the pilot pressure is guided to the pilot chamber 18*a*.

In the normal position (the state shown in FIG. 1) of the communication control valve 18, the boom system pilot pressure introducing passage pb is communicated with the pilot chamber 17*a* of the boom junction control valve 17. On the other hand, in the switched position of the communication control valve 18, communication between the boom system pilot pressure introducing passage pb and the pilot chamber 17*a* is cut off, and the pilot chamber 17*a* is connected to a drain passage 19.

The arm system pilot pressure introducing passage pa is a passage to which a pilot pressure for switching the arm switching valve 2 is guided, and is communicated with a passage that is connected to both pilot chambers of the arm switching valve 2. Further, the boom system pilot pressure introducing passage pb is a passage to which a pilot pressure for switching the boom switching valve 1 is guided, and is communicated with a passage that is connected to both pilot chambers of the boom switching valve 1.

Next, a case where the oil discharged by the third pump P3 joins the oil discharged by the second pump P2 and is supplied to the arm switching valve 2 will be described.

When each of the switching valves 3 and 9 and the boom junction control valve 17 provided in the third circuit system III is in the normal position (the state shown in FIG. 1), the third pump P3 is communicated with the center bypass passage 12. In this state, in a case where the arm junction control valve 11 is in the normal position (the state shown in FIG. 1), the center bypass passage 12 is communicated with the tank passage 20, and the oil discharged by the third pump P3 is returned to the tank T.

When the arm switching valve 2 is switched in this state, a pilot pressure from the arm system pilot pressure introducing passage pa is applied to the pilot chamber 11*a*, and the arm junction control valve 11 switches to the switched position on the left side in FIG. 1. In the switched position, communication between the center bypass passage 12 and the tank passage 20 is cut off. On the other hand, the arm joining passage 13 is always communicated with the arm switching valve 2. Therefore, in the switched position, the oil discharged by the third pump P3 is supplied to the arm cylinder 32 through the arm switching valve 2.

In a state in which the arm switching valve 2 is maintained in the normal position, that is, in a state in which communication between the second pump P2 and the arm cylinder 32 is cut off, a pilot pressure is not guided to the pilot chamber 18*a* of the communication control valve 18. For this reason, the communication control valve 18 is maintained in the normal position (the state shown in FIG. 1).

When the boom switching valve 1 is switched in this state, that is, when the first pump P1 is communicated with the boom cylinder 31, a pilot pressure from the boom system pilot pressure introducing passage pb is applied to the pilot chamber 17*a* of the boom junction control valve 17 through the communication control valve 18, and the boom junction control valve 17 switches to the switched position on the left side in FIG. 1. In the switched position, the third pump P3 is communicated with the boom joining passage 14 and the parallel passage 15, and the oil discharged by the third pump P3 is supplied to the boom switching valve 1 through the boom joining passage 14.

At this time, the oil discharged by the third pump P3 is also supplied to the bucket switching valve 5 that is connected in parallel to the boom switching valve 1 with respect to the boom joining passage 14. Further, the third pump P3 is also communicated with the parallel passage 15 through the boom junction control valve 17. Therefore, the oil discharged by the third pump P3 joins the oil discharged by the second pump P2 through the parallel passage 15, and is also supplied to the backup actuator switching valve 8 and the boom swing switching valve 7.

When the boom is operated in a state in which the arm is not operated, the boom junction control valve 17 becomes the switched position, and the oil discharged by the third pump P3 is supplied to the boom switching valve 1. When the arm switching valve 2 is switched in this state, a pilot pressure from the arm system pilot pressure introducing passage pa is applied to the pilot chamber 18*a* of the communication control valve 18, and the communication control valve 18 switches from the normal position to the switched position on the left side in FIG. 1.

In the switched position, communication between the pilot chamber 17*a* of the boom junction control valve 17 and the boom system pilot pressure introducing passage pb is cut off, and the pilot chamber 17*a* is communicated with the drain passage 19. Therefore, the pressure of the pilot chamber 17*a* becomes tank pressure, and the boom junction control valve 17 is returned to the normal position due to action of the spring 17*b*.

In a case where the boom junction control valve 17 becomes the normal position, communication between the third pump P3 and the boom joining passage 14 is cut off. Therefore, the oil discharged by the third pump P3 is not supplied to the boom switching valve 1 and the bucket switching valve 5, but is supplied to the arm switching valve 2 through the center bypass passage 12 and the arm joining passage 13. However, the oil discharged by the third pump P3 is supplied to the arm joining passage 13 only in a case where each of the switching valves 3 and 9 provided in the third circuit system III is maintained in the normal position and the arm junction control valve 11 is switched to the switched position.

As described above, when the arm is operating, that is, when the second pump P2 is communicated with the arm cylinder 32, communication between the third pump P3 and the boom joining passage 14 is cut off regardless of a switching operation of the boom switching valve 1, that is, regardless of whether the first pump P1 is communicated with the boom cylinder 31 or not. In other words, the discharged oil for junction that is discharged from the third pump P3 is preferentially supplied to the arm cylinder 32 compared with the boom cylinder 31. Therefore, even though the boom switching valve 1 switches when the oil discharged by the third pump P3 joins the arm switching valve 2, the switching does not cause the flow amount of discharged oil that is supplied to the arm cylinder 32 to decrease. Therefore, for example, in a power shovel, it is possible to carry out a control suitable for an operation in which a speed of the arm should be increased such as a horizontal pulling operation.

In addition, the communication control valve 18 switches only by a pilot pressure from the arm system pilot pressure introducing passage pa. For this reason, it is not necessary to select a spring that satisfies a predetermined relationship with the pilot pressure unlike the conventional control circuit.

According to the embodiment described above, the following effects are achieved.

When the arm switching valve 2 is switched, the communication between the third pump P3 and the boom switching valve 1 is cut off regardless of whether the boom switching valve 1 is switched or not. Therefore, the working oil that is discharged from the third pump P3 can preferentially be supplied to the arm cylinder 32 through the arm switching valve 2.

Further, the oil discharged by the third pump P3 can preferentially be supplied to the arm cylinder 32 only by switching the arm switching valve 2 regardless of whether the boom switching valve 1 is switched or not.

In this manner, the conventionally complicated selection of a spring is not required, and the oil discharged by the third pump P3 can preferentially be supplied to the arm cylinder 32 at the time of simultaneous operation of the boom cylinder 31 and the arm cylinder 32.

The embodiment of the present invention has been described above, but the above embodiment is merely a part of examples of application of the present invention, and the technical scope of the present invention is not limited to the specific configurations of the above embodiment.

For example, in the embodiment described above, an example in which hydraulic oil is used as the working fluid has been explained. However, instead of the oil, the other liquid such as water or a gas such as air can also be used as the working fluid.

The present application claims priority based on Japanese Patent Application No. 2012-245782 filed with the Japan Patent Office on Nov. 7, 2012, the entire content of which is incorporated herein by reference.

The invention claimed is:

1. A fluid pressure control device for a power shovel, comprising:

a first pump configured to supply working fluid to a first cylinder;

a second pump configured to supply working fluid to a second cylinder;

a first switching valve configured to permit or prohibit communication between the first pump and the first cylinder;

a second switching valve configured to permit or prohibit communication between the second pump and the second cylinder;

a third pump configured to allow to supply working fluid to the first cylinder and the second cylinder;

a first junction control valve configured to permit or prohibit communication between the third pump and the first cylinder or the second cylinder; and a communication control valve configured to prohibit communication between the third pump and the first cylinder to guide the working fluid discharged by the third pump to the second cylinder by controlling the first junction control valve in a case where the second pump is communicated with the second cylinder by the second switching valve regardless of whether or not the first pump is communicated with the first cylinder by the first switching valve.

2. The fluid pressure control device for a power shovel according to claim 1, wherein the first junction control valve is switched to a closing position in which communication between the third pump and the first cylinder is prohibited by means of a biasing force of a biasing member, and wherein the first junction control valve is switched to a communication position in which the third pump is communicated with the first cylinder when a pilot pressure for switching the first switching valve is guided to a pilot chamber thereof.

3. The fluid pressure control device for a power shovel according to claim 2, wherein, in a case where the first pump is communicated with the first cylinder by the first switching valve and the communication between the second pump and the second cylinder is cut off by the second switching valve, the communication control valve guides the pilot pressure for switching the first switching valve to the pilot chamber of the first junction control valve to switch the first junction control valve to the communication position.

4. The fluid pressure control device for a power shovel according to claim 2, Wherein, in a case where the second pump is communicated with the second cylinder by the second switching valve, the communication control valve causes the pilot chamber of the first junction control valve to communicate with a tank.

5. The fluid pressure control device for a power shovel according to claim 1, further comprising:

a second junction control valve configured to permit or prohibit communication between the third pump and a tank, wherein the second junction control valve is switched to a communication position in which the third pump is communicated with the tank by means of a biasing force of a biasing member, and wherein the second junction control valve is switched to a closing position in which communication between the third pump and the tank is cut off and the working fluid discharged by the third pump is guided to the second cylinder when a pilot pressure for switching the second switching valve is guided to a pilot chamber thereof.

6. The fluid pressure control device for a power shovel according to claim 5, wherein:

the first switching valve is provided between the first pump and the first cylinder, the second switching valve is provided between the second pump and the second cylinder, the first junction control valve is provided downstream from the third pump, and the second junction control valve is provided between the first junction control valve and the second switching valve.

* * * * *